US006848636B2

(12) United States Patent
Munezane et al.

(10) Patent No.: US 6,848,636 B2
(45) Date of Patent: Feb. 1, 2005

(54) FUEL INJECTION VALVE

(75) Inventors: Tsuyoshi Munezane, Hyogo (JP); Mamoru Sumida, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/414,164

(22) Filed: Apr. 16, 2003

(65) Prior Publication Data

US 2004/0074996 A1 Apr. 22, 2004

(30) Foreign Application Priority Data

Oct. 16, 2002 (JP) ..... P. 2002-301693

(51) Int. Cl.[7] ..... F02H 61/00
(52) U.S. Cl. ..... 239/533.12; 239/596; 239/533.2
(58) Field of Search ..... 239/533.12, 596, 239/533.2

(56) References Cited

U.S. PATENT DOCUMENTS 4,646,974 A * 3/1987 Sofianek et al. ..... 239/463
4,699,323 A * 10/1987 Rush et al. ..... 239/544
4,890,794 A * 1/1990 Imafuku et al. ..... 239/533.12
6,394,367 B2 5/2002 Munezane et al.
2002/0125347 A1 9/2002 Munezane et al.

FOREIGN PATENT DOCUMENTS

JP 2001-317431 A 11/2001

* cited by examiner

*Primary Examiner*—Dinh Q. Nguyen
(74) *Attorney, Agent, or Firm*—Sughrue Mion, PLLC

(57) ABSTRACT

A fuel injection valve includes a valve seat portion, a nozzle hole plate, and a valve member. The valve seat portion has an inner circumferential surface including a valve seat. The nozzle hole plate is disposed at a downstream side of a fuel passage of the valve seat. The nozzle hole plate has a nozzle hole for injecting fuel flowing out from the fuel passage. The valve member seats on the valve seat to close the fuel passage and unseats from the valve seat to open the fuel passage. Diameter of the inner circumferential surface decreases as approaching to a downstream side. The nozzle hole of the nozzle hole plate is formed so that length of radial outside of the nozzle hole with respect to a shaft center of the fuel injection valve is smaller than that of radial inside of the nozzle hole.

14 Claims, 6 Drawing Sheets

FUEL INJECTION VALVE

BACKGROUND OF THE INVENTION

1. Field of the Invention

This invention relates to a fuel injection valve for injecting fuel into an internal combustion engine, and particularly to a nozzle hole plate thereof.

2. Description of the Related Art

A fuel injection valve for injecting fuel from each nozzle hole has been known, in which a thin nozzle hole plate formed a plurality of nozzle holes is disposed in fuel downstream side of a valve portion formed of a valve member and a valve seat. In such a fuel injection valve, the nozzle hole generally has the same diameter from a nozzle hole inlet to a nozzle hole outlet. When fuel flows into such a nozzle hole with the same diameter, the fuel does not spread along an inner circumferential surface of the nozzle hole and is injected in a liquid column shape. The fuel formed in such a liquid column shape is resistant to atomization and combustion in an internal combustion is deteriorated.

On the contrary, there is a fuel injection valve, for example, disclosed in JP-A-2001-317431. FIG. 7 is a sectional view of a nozzle hole plate 21 thereof. The following fact has been known. As shown in FIG. 7, a nozzle hole axis line (chain double dashed line) is inclined with respect to a nozzle hole plate center line (dashed line). Furthermore, a nozzle hole outlet 22 is enlarged outwardly with respect to the nozzle hole plate center line so that the nozzle hole outlet 22 has larger diameter than a nozzle hole inlet 23. That is, a nozzle hole having a taper shape is inclined with respect to the nozzle hole plate center line. Whereby fuel injected from a nozzle hole 24 is prevented from becoming a liquid column so that the fuel spreads to become a liquid film and tends to be atomized.

[Patent Reference 1]

JP-A-2001-317431 (FIG. 7)

However, when the taper-shaped nozzle hole as described above is formed in the nozzle hole plate, very complicated process is required for its manufacture and size control, so that there are problems that deterioration of productivity of the fuel injection valve and an increase in cost are caused. Also, it has been generally known that atomization of fuel becomes better as a thickness of the nozzle hole plate is thinner. However, when the thickness of the nozzle hole plate is thinned, a spray angle of the fuel injected from the nozzle hole becomes large. Therefore, it is difficult that the nozzle hole plate has a certain extent of plate thickness, for example, 0.1 mm or less for reason of aspects of directivity of fuel spray and strength of the plate. Thus, it is inevitable to sacrifice the atomization of fuel to a certain extent.

SUMMARY OF THE INVENTION

The invention solves the problems as described above. An object of the invention is to provide a fuel injection valve, which can be manufactured by a simple process and can atomize fuel spray without sacrificing strength of a nozzle hole plate and directivity of fuel injection.

According to a first aspect of the invention, there is provided a fuel injection valve including a valve seat portion, a nozzle hole plate, and a valve member. The valve seat portion has an inner circumferential surface including a valve seat. The nozzle hole plate is disposed at a downstream side of a fuel passage of the valve seat. The nozzle hole plate has a nozzle hole for injecting fuel flowing out from the fuel passage. The valve member seats on the valve seat to close the fuel passage and unseats from the valve seat to open the fuel passage. Diameter of the inner circumferential surface decreases as approaching to a downstream side. The nozzle hole of the nozzle hole plate is formed so that length of radial outside of the nozzle hole with respect to a shaft center of the fuel injection valve is smaller than that of radial inside of the nozzle hole. Therefore, fuel spray can be atomized without sacrificing directivity of fuel injection.

According to a second aspect of the invention, thickness of the nozzle hole plate is thick in the neighbor of the shaft core of the fuel injection valve and is thin on a outer circumferential side. The nozzle hole is formed to stride a step portion at which the thickness of the nozzle hole plate switches. Therefore, a fuel injection valve, which can atomize the fuel spray without sacrificing directivity of fuel injection, be obtained by a simple process. Productivity can be improved and production cost can be reduced.

According to a third aspect of the invention, a circular groove having the shaft core of the fuel injection valve as a center is formed in the nozzle hole plate. The plurality of nozzle holes are formed to stride a radial inside wall of the circular groove. Therefore, a fuel injection valve, which can atomize fuel spray without sacrificing strength of the nozzle hole plate and directivity of fuel injection, can be obtained by a simple process. Productivity can be improved and production cost can be reduced.

According to a fourth aspect of the invention, the nozzle hole is a plurality of nozzle holes. A recess portion is formed to correspond to each of outlets of the nozzle holes. Therefore a fuel injection valve, which can atomize the fuel spray without sacrificing strength of the nozzle hole plate and directivity of fuel injection, can be obtained by a simple process. The fuel spray shape can be set optimally. Productivity can be improved and production cost can be reduced.

According to a fifth aspect of the invention, the nozzle hole has the same diameter from an inlet thereof to an outlet thereof. Therefore, a process for forming the nozzle hole is further simplified. The productivity can be improved further. The production cost can be reduced further.

According to a sixth aspect of the invention, the nozzle hole is a plurality of nozzle holes. The nozzle holes are disposed on a circular arc having the shaft core of the fuel injection valve as a center. Therefore, the degree of atomization of fuel injected from each of nozzle holes arranged in the nozzle hole plate becomes uniform. The fuel spray atomized uniformly as a whole can be obtained.

According to a seventh aspect of the invention, the plurality of nozzle holes are disposed at regular intervals in a circumferential direction. Therefore, uniformity of the fuel spray can be further improved.

According to an eighth aspect of the invention, all of the plurality of nozzle holes are disposed at regular intervals in the circumferential direction. Therefore, the uniformity of the fuel spray can be improved furthermore.

DETAILED DESCRIPTION OF THE PREFERRED EMBODIMENTS

First Embodiment

One embodiment of the invention will be described below.

Figure 1:
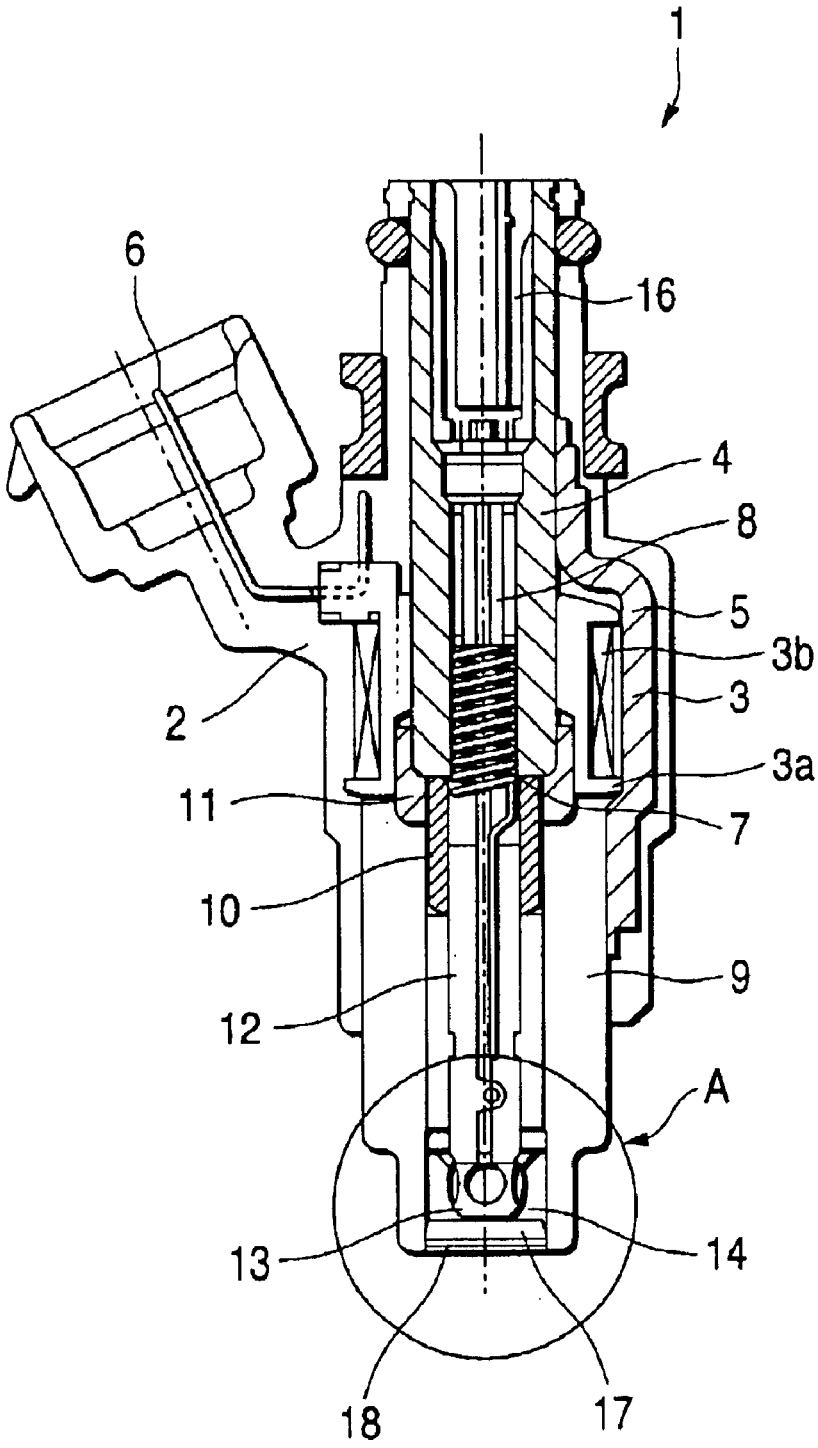
FIG. 1 is the whole configuration view of a fuel injection valve according to a first embodiment.

FIG. 1 shows one embodiment of the invention and is a sectional side view showing the whole configuration of a fuel injection valve 1. An electromagnetic coil 3, a fixed core 4, and metal plates 5 forming a magnetic path are disposed in a resin housing 2 so that the fuel injection valve 1 is integrally molded. The electromagnetic coil 3 includes a resin-made bobbin 3*a*, a coil 3*b* wound on the outside of the bobbin 3*a*, and a terminal 6 provided for connection to an outside. The electromagnetic coil 3 is integrally molded with the resin housing 2.

An adjuster 8 for adjusting a load of a compression spring 7 is fixed in a fixed core 4. One end of the two metal plates 5 forming the magnetic path is fixed to the fixed core 4 by welding. The other end thereof is welded to an electromagnetic pipe 9 forming a magnetic path. A non-magnetic pipe 11 is fixed to the fixed core 4 and the magnetic pipe 9 and is disposed between the fixed core 4 and the magnetic pipe 9 so that a movable core 10 is vertically-slidably disposed in the magnetic core.

A needle pipe 12 is welded and fixed to one end of the movable core 10. One end of the needle pipe 12 on a movable core 10 side abuts against the compression spring 7. A ball 13 acting as a valve is welded and fixed to the other end thereof. The ball 13 is disposed so that the ball 13 is guided to a valve seat 14 disposed in the magnetic pipe 9 and can be seated to and unseated from a seat portion 14*a* of the valve seat 14. A plane portion is formed on a surface of the ball 13, which is opposed to a nozzle hole plate 17. Also, an outer circumferential part of the ball 13 is processed in a pentagon and forms a fuel path along with a guide portion 14*b* of the valve seat 14. Further, in order to inject fuel passing through the fuel path toward, for example, an intake manifold (not shown) of an internal combustion engine, a nozzle hole plate 17 including a plurality of nozzle holes 18 is disposed to configure the fuel injection valve 1. Also, a filter 16 for filtering the fuel flowing from a delivery pipe (not shown) is disposed in an upper portion of the fuel injection valve 1.

Next, an operation of the fuel injection valve will be described. When the coil 3 is energized through the terminal 6 from the outside, a magnetic flux is generated in the magnetic path formed of the fixed core 4, the metal plates 5, the magnetic pipe 9 and the movable core 10. The movable core 10 is attracted to the fixed core 4 by electromagnetic attraction. The needle pipe 12 integrally joined to the movable core 10 and the ball 13 welded and fixed to the needle pipe 12 operate so that a fuel path is opened between the valve seat 14*a* of the valve seat 14 and the ball 13. Thus, fuel is injected from the nozzle holes 18 formed in the nozzle hole plate 17.

Figure 2:
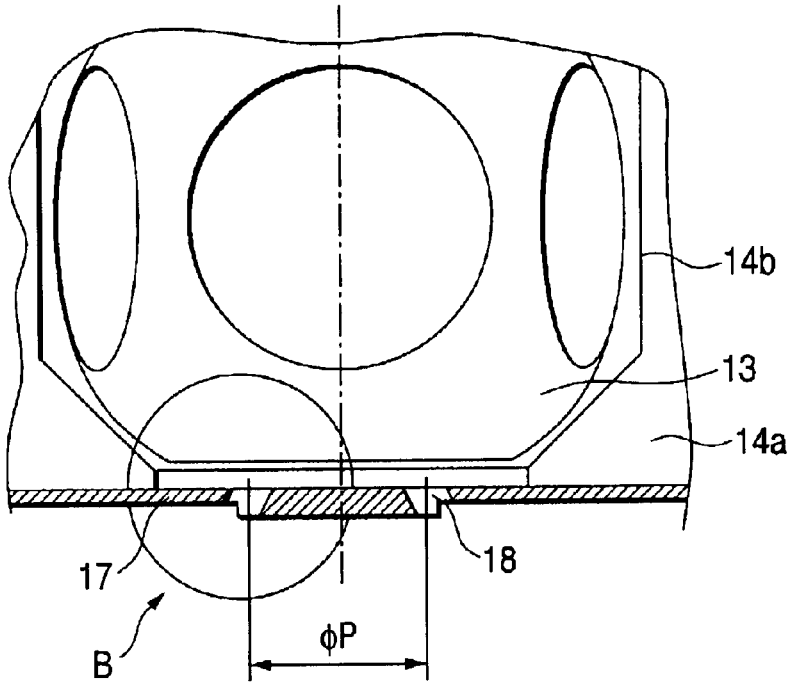
FIG. 2 is an enlarged view of a main portion of the fuel injection valve according to the first embodiment.
Figure 3:
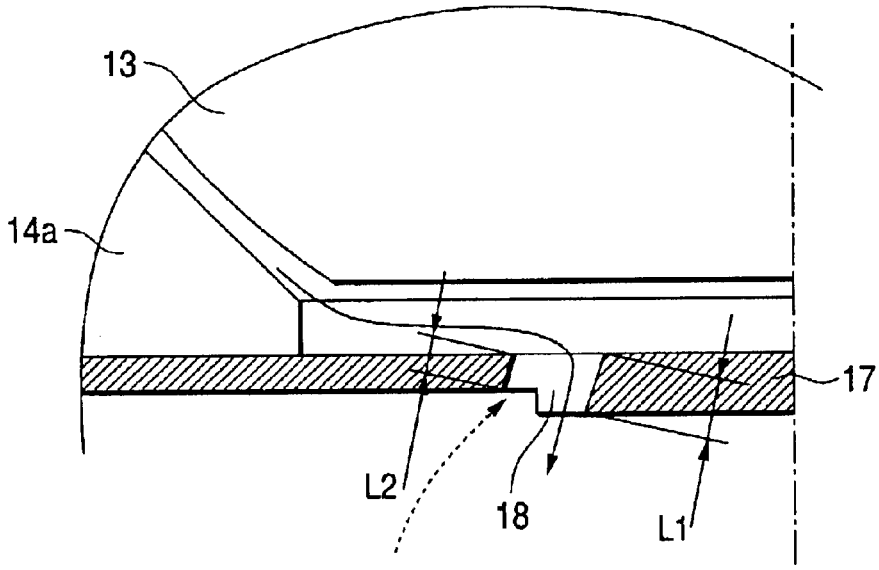
FIG. 3 is a view in which the main portion of the fuel injection valve according to the first embodiment is further enlarged.

Here, FIG. 2 is an enlarged view of a portion surrounded by a circle A of FIG. 1. FIG. 3 is a view in which a portion surrounded by a circle B of FIG. 2 is further enlarged. In FIG. 3, the nozzle hole 18 is configured so that a nozzle hole length L1 of radial inside with respect to a shaft center of the fuel injection valve and a nozzle hole length L2 of radial outside satisfy L1>L2. The fuel passing through the fuel path between the valve seat 14*a* and the ball 13 flows along the radial inside of the nozzle hole 18 as shown in a solid line. Since the nozzle hole length L1 of the radial inside of this nozzle hole 18 is enough ensured, a spray angle does not spread widely. On the other hand, since the nozzle hole length L2 of the radial outside of the nozzle hole 18 is short, air is involved as shown in a broken line in a case of injecting fuel to promote mixture with the air before injecting fuel from the nozzle hole 18. Thus, atomization of fuel spray can be achieved. That is, a relation between the nozzle hole length L1 of the radial inside and the nozzle hole length L2 of the radial outside of the nozzle hole 18 satisfies L1>L2. Whereby, the atomization is enabled without sacrificing directivity of the fuel spray.

Figure 4:
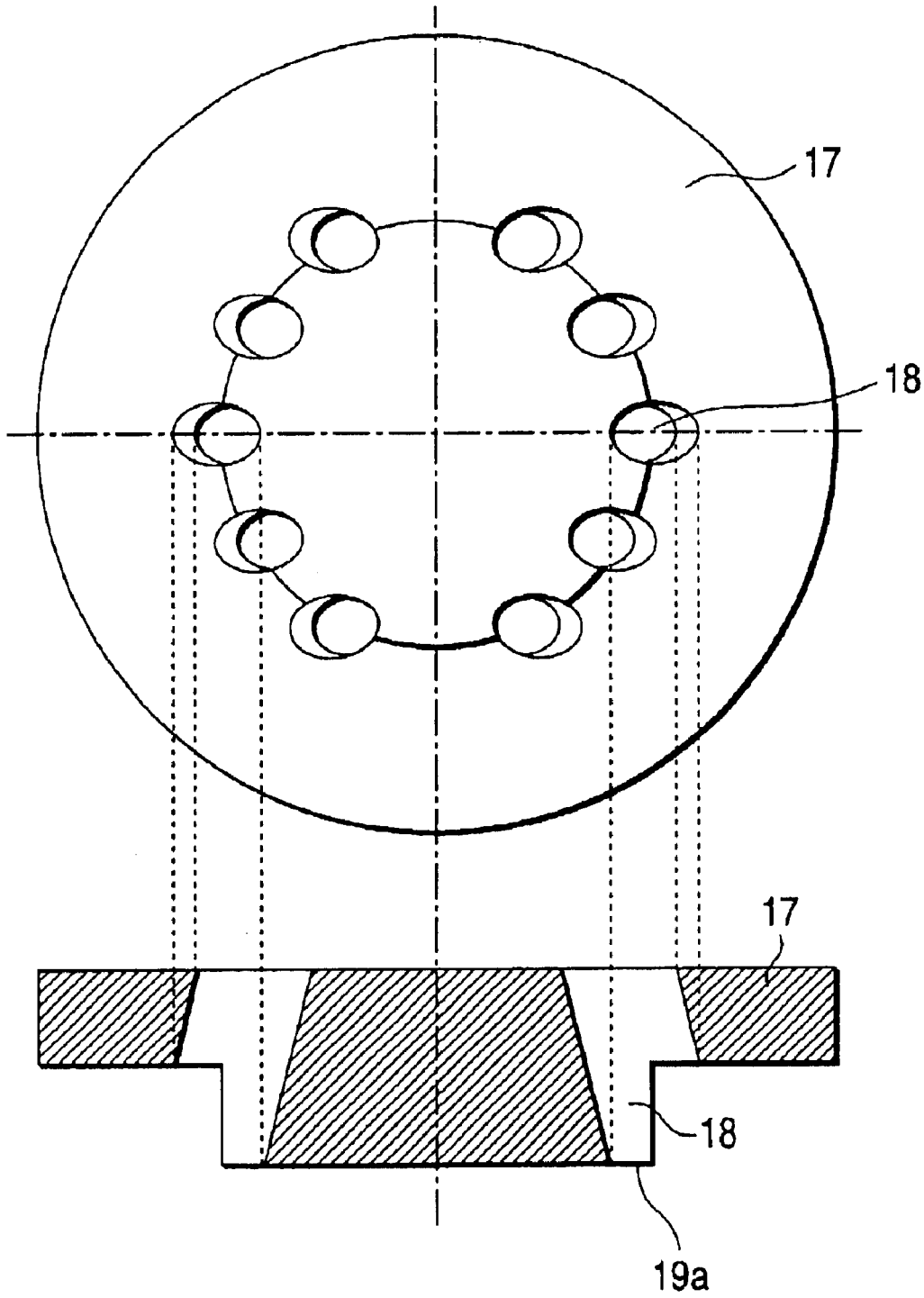
FIG. 4 is a view showing a nozzle hole plate of a fuel injection valve according to a second embodiment.

Next, a method for configuring the relation of L1>L2 described above will be described. FIG. 4 is a view extracting only the nozzle hole plate 17. Here, the nozzle holes 18 are formed on a circular arc with a diameter of $\phi P$ about the shaft center of the fuel injection valve as shown in FIG. 2. This nozzle hole 18 is the so-called straight nozzle hole with the same nozzle hole diameters from a nozzle hole inlet to a nozzle hole outlet. Further, as shown in FIG. 4, in the nozzle hole plate 17, a plate thickness of the inner circumferential side with respect to the shaft center of the fuel injection valve is formed larger than a plate thickness of the outer circumferential side. The nozzle hole 18 is formed so as to stride a stage portion 19*a* in which the plate thickness switches. Whereby a portion of the radial outside of the nozzle hole 18 is notched. Since the portion of the nozzle hole 18 is thus notched, the relation of L1>L2 described above can be configured.

The nozzle hole as described above can be manufactured in the following manner. The outer circumferential portion having thin plate thickness is formed in a raw material of the plate by press. Then, the straight nozzle holes are formed in the plate by press. Therefore, it is easy to manufacture the nozzle hole plate and good productivity and low cost can be achieved.

As described above, a plate thickness of the inner circumferential side of the nozzle hole plate is formed thicker than a plate thickness of the outer circumferential portion thereof and the nozzle hole is formed to stride the stage portion at which the plate thickness switches. Whereby an electromagnetic type fuel injection valve, which can be manufactured by a simple process and can atomize fuel spray without sacrificing directivity of fuel injection, can be provided.

Second Embodiment

In the first embodiment, a plate thickness of the inner circumferential side of the nozzle hole plate 17 is formed thicker than a plate thickness of the outer circumferential portion thereof and the nozzle hole is formed to stride the stage portion 19*a* at which the plate thickness switches. However, when a fuel pressure is high and it is necessary to ensure a strength of the nozzle hole plate 17, the nozzle hole plate 17 may be formed as shown in FIG. 5.

Figure 5:
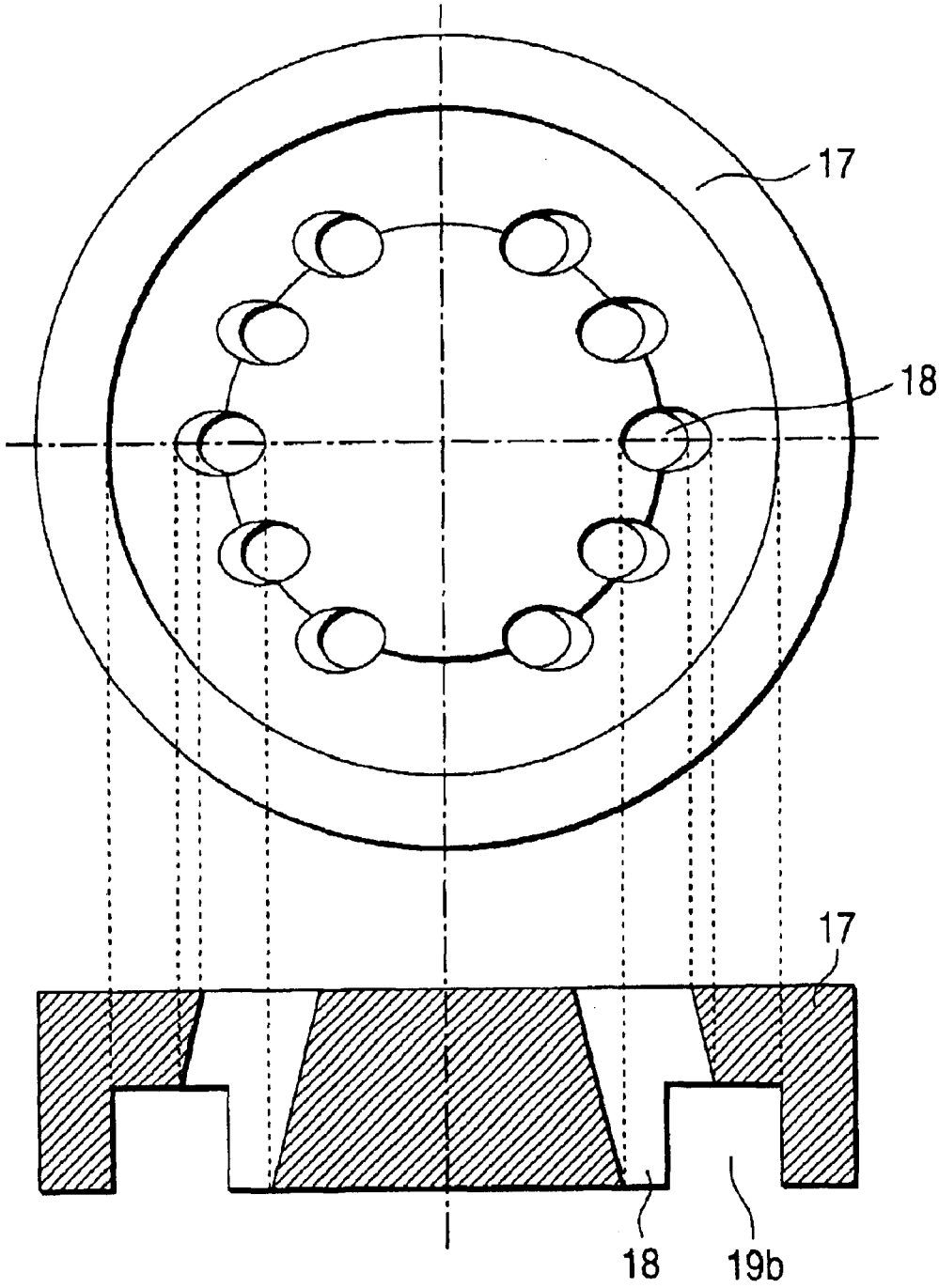
FIG. 5 is a view showing a nozzle hole plate of the fuel injection valve according to the second embodiment.

As shown in FIG. 5, an annular groove 19*b* about the shaft center of the fuel injection valve is formed in the nozzle hole plate 17. Further, nozzle holes 18 are formed to stride a surface of the radial inside of the groove 19*b*. Since the nozzle holes 18 are thus formed, a portion of the radial outside of the nozzle hole 18 is notched and the relation of L1>L2 described above can be satisfied.

Such a nozzle hole plate can be manufactured by a simple process such as a process for forming the groove and a process for forming the nozzle hole in a manner similar to the nozzle hole plate according to the first embodiment. An electromagnetic type fuel injection valve can be obtained which can atomize fuel spray without sacrificing directivity of fuel injection. In addition, a plate thickness of only a portion of the groove 19*b* is thin and sufficient strength can be ensured.

Incidentally, in the second embodiment, a case is described in which the groove 19*b* is formed in annular shape. However, it goes without saying that shape of the groove is not limited to the annular shape and can be changed according to arrangement of the nozzle hole. Also, the groove is not necessarily formed in annular shape. Even if grooves have any shape such as a portion of a circular arc or straight shape according to arrangement of the nozzle hole and further even if one groove is not provided with respect to all of plural nozzle holes but the nozzle holes are divided into some groups (for example, in the nozzle holes of FIG. 5, the nozzle holes of the right half of FIG. 5 are classified as a first group and the nozzle holes of the left half are classified as a second group) and a groove is provided each of groups, the relation of L1>L2 can similarly be satisfied. Therefore, similar effect can be achieved.

Third Embodiment

Figure 6:
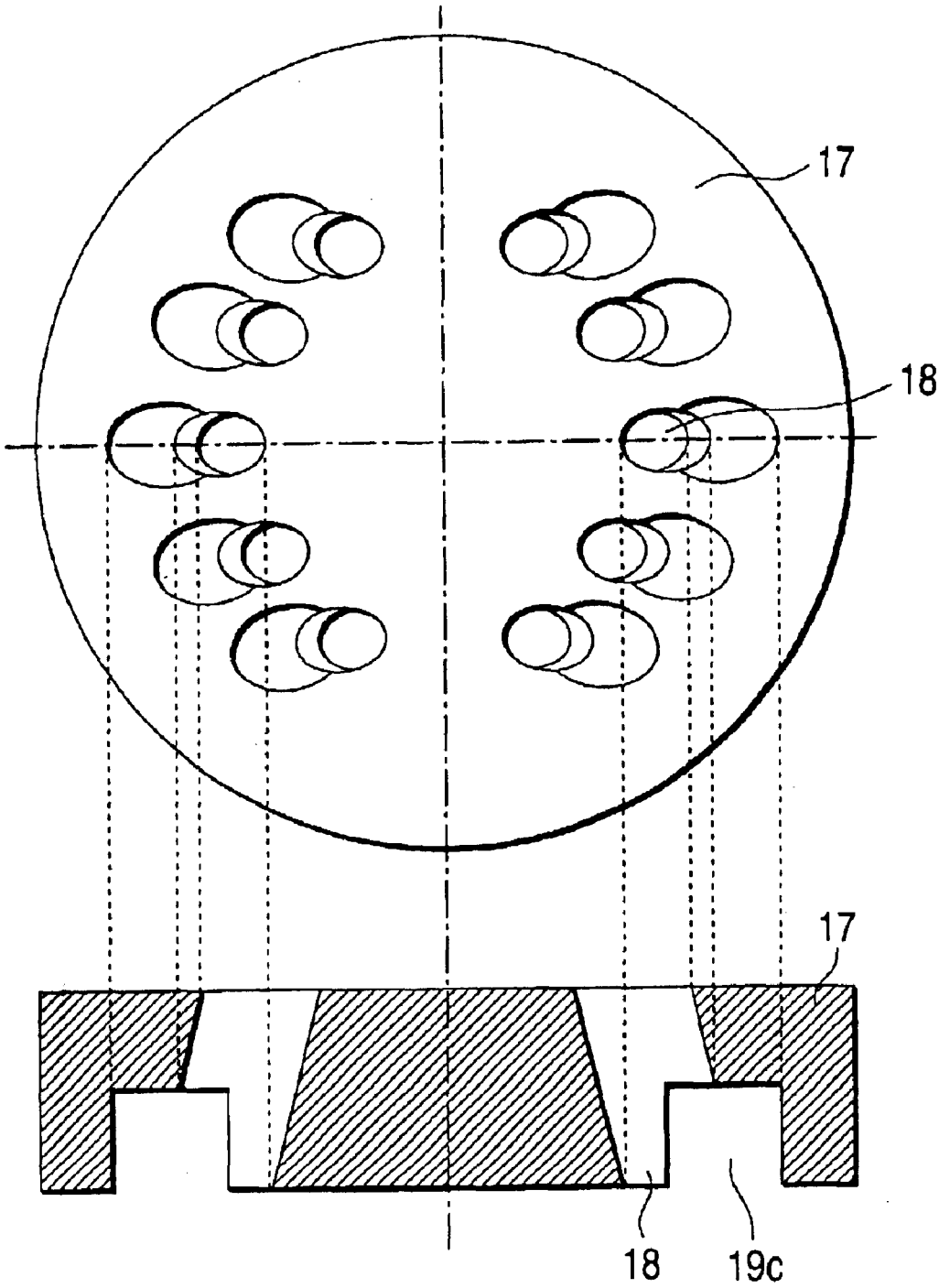
FIG. 6 is a view showing a nozzle hole plate of a fuel injection valve according to a third embodiment.
Figure 7:
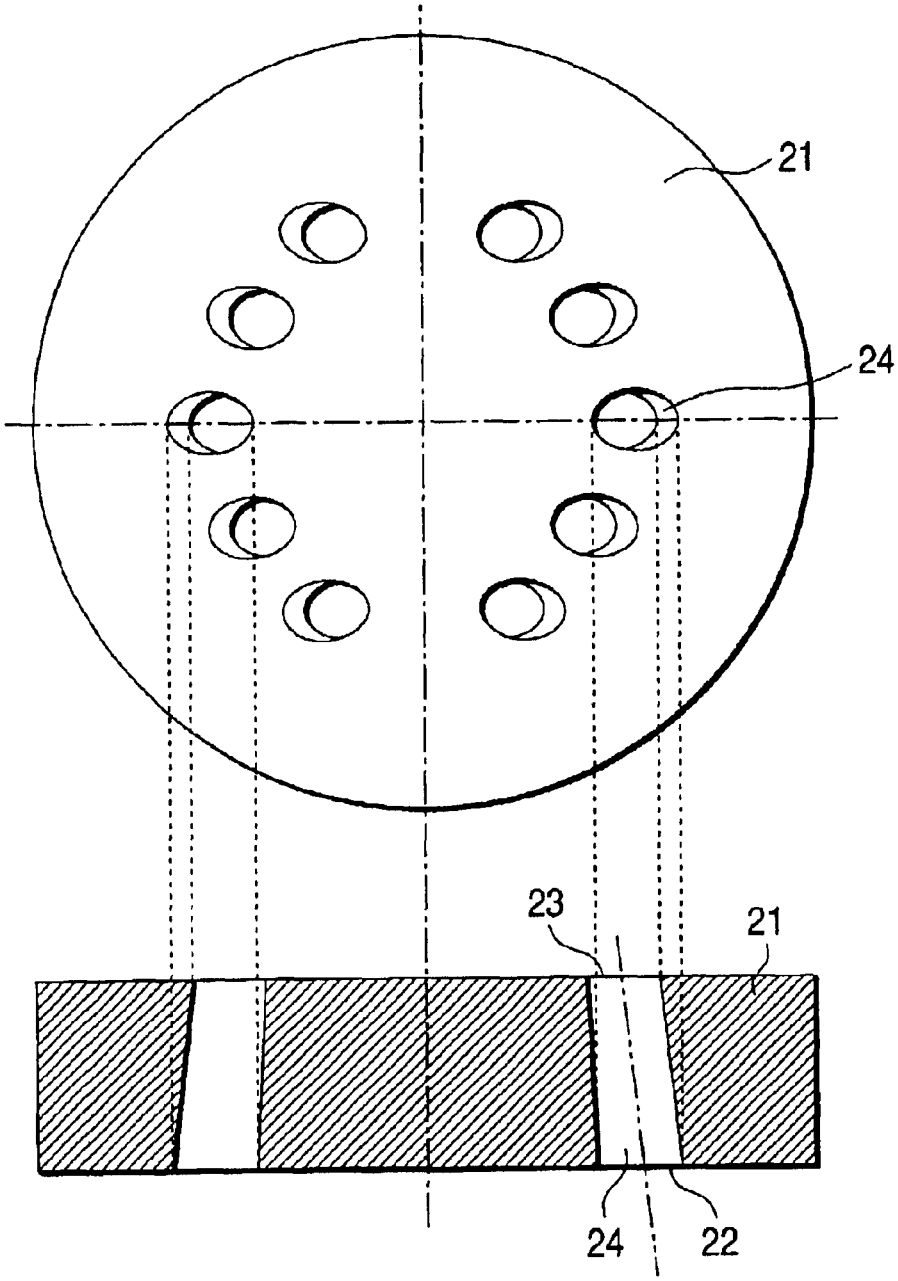
FIG. 7 is a view showing a nozzle hole plate of a conventional fuel injection valve.

In the first and second embodiments, one stage portion or one groove is provided with respect to a plurality of nozzle holes. However, as shown in FIG. 6, one recess portion 19*c* may be formed with respect to one nozzle hole 18 and each of nozzle holes 18 may be formed to stride a surface of the radial inside of each of the recess portion 19*c*. Since the nozzle holes 18 are thus formed, a portion of the radial outside of the nozzle hole 18 is notched and the relation of L1>L2 described above can be satisfied.

Such a nozzle hole plate can be manufactured by a simple process such as a process for forming the recess portion by a press and a process for forming the nozzle hole by a press in a manner similar to the nozzle hole plate according to the first embodiment. An electromagnetic type fuel injection valve can be obtained, which can atomize fuel spray without sacrificing strength of the nozzle hole plate and directivity of fuel injection. In addition, a plate thickness of only a portion of the groove 19*b* is thin and sufficient strength can be ensured. Further, the recess portion can be formed in the optimum direction with respect to directivity of each the nozzle hole, so that the optimum spray shape can be obtained.

Incidentally, in any of the embodiments described above, the nozzle holes are formed on a circular arc with a diameter of ϕP about the shaft center of the fuel injection valve. Therefore, the degree of atomization of fuel injected from each of nozzle holes arranged in the nozzle hole plate becomes uniform and spray atomized uniformly as a whole can be obtained.

Also, for example, when ten nozzle holes are formed in the nozzle hole plate as shown in FIG. 4, the nozzle holes formed on a circle having diameter of ϕP about the shaft of the fuel injection valve are divided into five on a left half of the drawing and five on a right half thereof. The nozzle holes are arranged at regular interval in a circumferential direction in each of groups. Whereby uniformity of the fuel spray can be further improved.

What is claimed is:

1. A fuel injection valve comprising:

a valve seat portion having an inner circumferential surface including a valve seat;

a nozzle hole plate disposed at a downstream side of a fuel passage of the valve seat, the nozzle hole plate having a nozzle hole for injecting fuel flowing out from the fuel passage; and a valve member, which seats on the valve seat to close the fuel passage and unseats from the valve seat to open the fuel passage, wherein a diameter of the inner circumferential surface decreases as approaching to the downstream side, wherein the nozzle hole of the nozzle hole plate is formed so that a length of a radial outside of the nozzle hole with respect to a shaft center of the fuel injection valve is smaller than that of a radial inside of the nozzle hole, the radial outside of the nozzle hole being disposed in an outer portion of the nozzle hole plate and the radial inside of the nozzle hole being disposed in an inner portion of the nozzle hole plate, wherein at least one of the radial outside of the nozzle hole and the radial inside of the nozzle hole has a portion angled away from the shaft center in a flow direction of the injection fuel, and wherein the inner portion of the nozzle hole plate has a top surface and a bottom surface which are parallel, and the inner portion of the nozzle hole plate is thicker than the outer portion of the nozzle hole plate.

2. The fuel injection valve according to claim 1, wherein thickness of the nozzle hole plate is thick in the neighborhood of the shaft core of the fuel injection valve and is thin on a outer circumferential side; and wherein the nozzle hole is formed to stride a step portion at which the thickness of the nozzle hole plate switches.

3. The fuel injection valve according to claim 1, wherein a circular groove having the shaft core of the fuel injection valve as a center is formed in the nozzle hole plate;

wherein the plurality of nozzle holes are formed to stride a radial inside wall of the circular groove.

4. The fuel injection valve according to claim 1, wherein the nozzle hole is a plurality of nozzle holes; and wherein a recess portion is formed to correspond to each of outlets of the nozzle holes.

5. The fuel injection valve according to claim 1, wherein the nozzle hole has the same diameter from an inlet thereof to an outlet thereof.

6. The fuel injection valve according to claim 1, wherein the nozzle hole is a plurality of nozzle holes; and wherein the nozzle holes are disposed on a circular arc having the shaft center of the fuel injection valve as a center.

7. The fuel injection valve according to claim 6, wherein the plurality of nozzle holes are disposed at regular intervals in a circumferential direction.

8. The fuel injection valve according to claim 7, wherein all of the plurality of nozzle holes are disposed at regular intervals in the circumferential direction.

9. The fuel injection valve according to claim 1, wherein both of the radial inside of the nozzle hole and the radial outside of the nozzle hole have a portion which is angled away from the shaft center.

10. The fuel injection valve according to claim 1, wherein the outer portion of the nozzle hole plate has a top surface and a bottom surface which are parallel.

11. A fuel injection valve comprising:

a valve seat portion having an inner circumferential surface including a valve seat;

a nozzle hole plate disposed at a downstream side of a fuel passage of the valve seat, the nozzle hole plate having a nozzle hole for injecting fuel flowing out from the fuel passage; and a valve member, which seats on the valve seat to close the fuel passage and unseats from the valve seat to open the fuel passage, wherein diameter of the inner circumferential surface decreases as approaching to the downstream side, wherein the nozzle hole of the nozzle hole plate is formed so that a length of a radial outside of the nozzle hole with respect to a shaft center of the fuel injection valve is smaller than that of a radial inside of the nozzle hole, wherein the nozzle hole is a plurality of nozzle holes, and wherein a recess portion is formed to correspond to each of outlets of the nozzle holes.

12. The fuel injection valve according to claim 11, wherein the nozzle holes have the same diameter from an inlet thereof to an outlet thereof.

13. The fuel injection valve according to claim 11, wherein the nozzle holes are disposed on a circular arc having the shaft center of the fuel injection valve as a center.

14. The fuel injection valve according to claim 11, wherein the plurality of nozzle holes are disposed at regular intervals an a circumferential direction.

* * * * *